US006786750B2

(12) United States Patent
Itoh

(10) Patent No.: US 6,786,750 B2
(45) Date of Patent: Sep. 7, 2004

(54) SELF-LOCATING CONNECTOR

(75) Inventor: Nozomi Itoh, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 10/384,671

(22) Filed: Mar. 11, 2003

(65) Prior Publication Data

US 2003/0171019 A1 Sep. 11, 2003

(30) Foreign Application Priority Data

Mar. 11, 2002 (JP) ..... 2002-065538
Mar. 12, 2002 (JP) ..... 2002-067308

(51) Int. Cl.[7] ..... H01R 13/69
(52) U.S. Cl. ..... 439/247; 439/248
(58) Field of Search ..... 439/247, 248, 439/246, 362, 364, 342, 310, 752

(56) References Cited

U.S. PATENT DOCUMENTS 6,059,599 A * 5/2000 Huang ..... 439/362
6,217,363 B1 * 4/2001 Takata ..... 439/342
6,592,387 B2 * 7/2003 Komenda et al. ..... 439/247

FOREIGN PATENT DOCUMENTS

| | | |
|---|---|---|
| EP | 0 349 134 A1 | 1/1990 |
| EP | 0 694 998 A2 | 1/1996 |
| FR | 931 803 | 3/1948 |
| GB | 952652 | 3/1964 |
| JP | 6-325823 A | 11/1994 |

* cited by examiner

*Primary Examiner*—Alex Gilman
(74) *Attorney, Agent, or Firm*—Foley & Lardner LLP

(57) ABSTRACT

A self-locating connector comprising a first connector that houses male terminals or female terminals, a second connector that houses the female terminals or the male terminals, a support bracket that slidably supports the first connector, and a support bracket that slidably supports the second connector, in which one of the both connectors can be moved in substantially right and left directions when fitting the both connectors, the other one of the both connectors can be moved in substantially up and down directions, and thus an axial deviation between the both connectors is automatically adjusted.

8 Claims, 8 Drawing Sheets

M
P
R
10
20
21
22
24
27
28
101
102
105
108
110
112
212
216
221
223
225
226
241
242
246

SELF-LOCATING CONNECTOR

BACKGROUND OF THE INVENTION

1. Field of the Invention

The present invention relates to a connection structure of a connector used for connecting electric equipment.

Particularly, the present invention relates to a self-locating connector mounted on an instrument module installed on an automobile or the like.

2. Description of Prior Art

Conventionally, there has been known a self-locating connector that connects a body harness which is cabled in an automobile body with an instrument harness cabled to an electric equipment such as a meter, an audio apparatus or an air conditioner which is housed in an instrument panel or an under region of the panel (see Japanese Patent Laid-Open No. Hei 06-325823).

FIGS. 7 to 9 show the self-locating connector disclosed in the Japanese Patent Laid-Open No. Hei 06-325823.

FIG. 7 is a perspective view of a conventional male connector. The male connector 51 is equipped to the body of an automobile, for example. The male connector has a housing main body 510 having a rectangular solid shape, and male terminals are provided on the bottom surface of the housing main body 510.

FIG. 8 is an exploded perspective view of a conventional female connector device 60. The female connector device 50 has a female connector 52 and a bracket 53. The female connector 52 has a housing main body 520 having a rectangular solid shape. Female terminals are provided in the housing main body 520. Four stopper pieces 521 are provided at the end portions of the housing main body 520.

The bracket 53 is provided with elastic pieces 531, 532 disposed within an opening end portion thereof. The bracket 53 elastically supports the female connector 52 by the elastic pieces 531, 532 to position in the side of the instrument panel of the automobile, for example.

FIG. 9 is an exemplary view showing a state before fitting the conventional male connector and the female connector, and the male connector 51 as shown in FIG. 7 and the female connector 52 as shown in FIG. 8 are fitted as will be described below.

A certain amount of attachment error occurs when the instrument panel to which the female connector device 50 is attached is assembled to the automobile body to which the male connector 51 is attached.

However, in the self-locating connector of this conventional example, the bracket 53 directly attached to the automobile body supports the female connector 52 via the elastic pieces 531, 532, so that the female connector 52 displaces up and down, and right and left when fitting with the male connector 51 within a range that the elastic pieces 531, 532 can bend even if the attachment error occurs.

Specifically, even if there is a dimensional error within a certain range between the automobile body and the instrument panel, a nut 522 of the female connector 52 and a screw member 54 of the male connector 51 are screwed with each other and the female connector 52 and the male connector 51 can be fastened.

However, in the conventional self-locating connector, since bending of the elastic pieces 531, 532 absorbs the dimensional error between the automobile body and the instrument panel, it is necessary to obtain a large shape of the elastic pieces 531, 532 in order to increase an absorption quantity of dimensional error.

Further, the elastic pieces 531, 582 are made to contact the circumference of the housing main body 520 of the female connector 52 in a sliding manner, and thus fitting the male connector 51 and the female connector 52, so that the elastic pieces 531, 532 need to secure a predetermined strength and rigidity to a load into a fitting direction as well.

Therefore, the elastic pieces have too much design restrictions to increase the absorption quantity of dimensional error, and absorption of the dimensional error is limited.

Moreover, an impossible force, especially, a torsion force arising from bending stress and tensile stress by harness is applied to the male terminals and the female terminals depending on how the harness is cabled, and connecting-operation efficiency between the both connectors is impaired. Furthermore, reliability of connection between the male terminals and the female terminals also reduces.

SUMMARY OF THE INVENTION

It is, therefore, an object of the present invention to provide a self-locating connector preferably applied for the instrument module, which is capable of increasing an allowable quantity or absorption quantity of deviation of positioning between the male connector and the female connector, improving the connecting-operation efficiency between the both connectors, and improving the reliability of connection between the male terminals and the female terminals.

The self-locating connector according to the present invention includes a first connector that houses the male terminals or the female terminals, a second connector that houses the female terminals or the male terminals, a support bracket that slidably supports the first connector, and a support bracket that slidably supports the second connector, in which one of the both connectors can be moved in approximate right and left directions when fitting the both connectors, the other one of the both connectors can be moved in approximate up and down directions, and thus an axial deviation (off-set) between the both connectors are automatically adjusted.

The self-locating connector of the present invention further preferably includes a locator that inserts the housing main body of the first connector inside slidably in an axial direction of the male terminals or the female terminals, in which the locator adjusts the axial deviation between the both connectors.

Further, the locator preferably has the housing main body, in which guide grooves formed by a positioning portion and a hooking nail are provided, rail portions guided by the guide grooves are formed on a support bracket that supports the first connector, and the housing main body of the second connector is provided with the guide grooves formed by the hooking nail and a guide portion, rail portions guided by the guide grooves are formed on the support bracket that supports the second connector, and movable mechanism of the first connector and movable mechanism of the second connector are made up of the guide grooves and the rail portions, respectively.

Further, it is desirable that at least a pair of locating pins, which have a slope for guiding the second connector to facilitate fitting of the second connector, be provided on the tip of the locator, and the second connector be provided with auxiliary locating pins having a slope that inscribes the slope of a pair of the locating pins.

Furthermore, it is also desirable that the locator be provided with a concave area, which is made up of a pair of parallel surface portions having predetermined dimensions in an axial direction followed by the slope, the second connector is provided with a pair of parallel surface portions followed by the slope, which contacts a pair of the parallel surface portions of the first connector in a sliding manner, and the axis core shift be automatically adjusted by the parallel surface portions formed on the both connectors before the fitting of the male terminals and the female terminals during a fitting operation of the both terminals starts.

Furthermore, it is desirable a lever, which has a handle operation portion and can move the first connector in an axial direction with respect to the locator, be provided for the housing main body of the locator, a cam groove that engages with a guide pin, which is provided for the first connector in a protruding manner, and cam grooves that engage with a pair of guide pins, which are provided on a pair of parallel surface portions of the second connector in a protruding manner, be formed on the lever, the locator rotatably support the lever, and the both connectors be fitted by rotating the handle operation portion.

Moreover, it is further desirable that a harness cabled to the first connector is cabled by being pulled out in a direction orthogonal to the movable direction of the first connector, and a harness cabled to the second connector be cabled by being pulled out in a direction orthogonal to the movable direction of the second connector.

Still further, the self-locating connector according to the present invention includes the first connector that houses the male terminals or the female terminals, the second connector that houses the female terminals or the male terminals, the support bracket fixed to the instrument module and that slidably supports the first connector, the support bracket fixed to the automobile body and that slidably supports the second connector in a direction orthogonal to the movable direction of the first connector, in which one of the both connectors can be moved in approximate right and left directions when fitting the both connectors, the other one of the both connectors can be moved in approximate up and down directions, and thus the axial deviation between the both connectors is automatically adjusted.

DETAILED DESCRIPTION OF THE EMBODIMENTS

Figure 1:
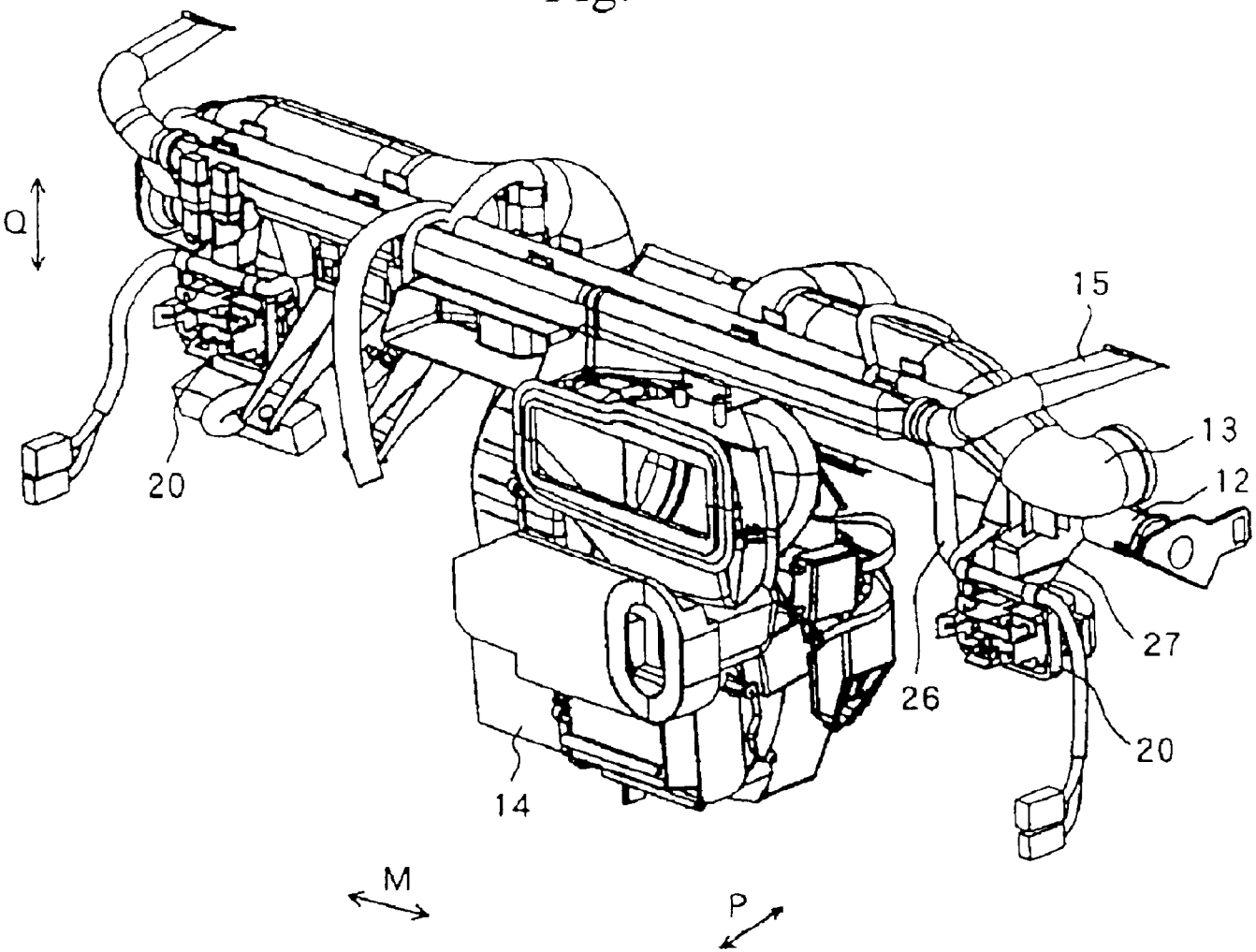
FIG. 1 is a perspective view of an instrument module according to the embodiments of the present invention.

FIG. 1 is the perspective view of the instrument module in embodiments of the present invention. The instrument module comprises a steering member 12, and parts such as an air conditioner 14, a vent duct 13, a defroster nozzle 15 and a harness 26 are equipped using the steering member 12 as a reference. Connector devices 20 are equipped on the both ends of the steering member 12 via brackets 27.

Figure 2:
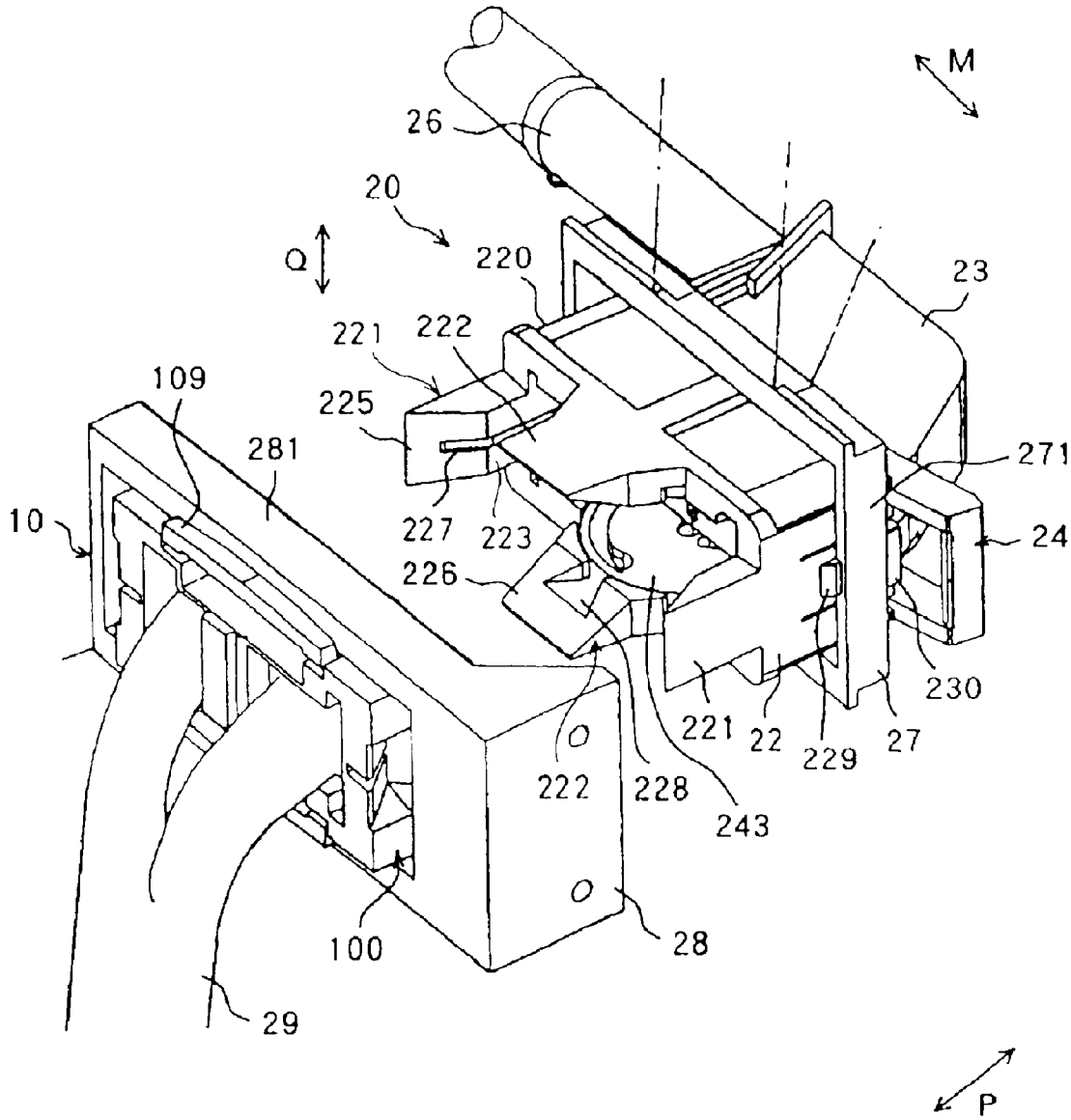
FIG. 2 is a perspective view of the instrument module and a connector of an automobile before fitting according to the embodiments of the present invention.

FIG. 2 is the perspective view of the instrument module and the connector of the automobile body before fitting in the embodiments of the present invention, which shows a state where a pair of the male connector and the female connector are severally assembled to the bracket 27 of the instrument module and a bracket 28 of the automobile body.

In FIG. 2, arrow P, arrow M and arrow Q respectively show an automobile body forward and backward direction, an automobile body right and left direction, and an automobile up and down direction.

Figure 3:
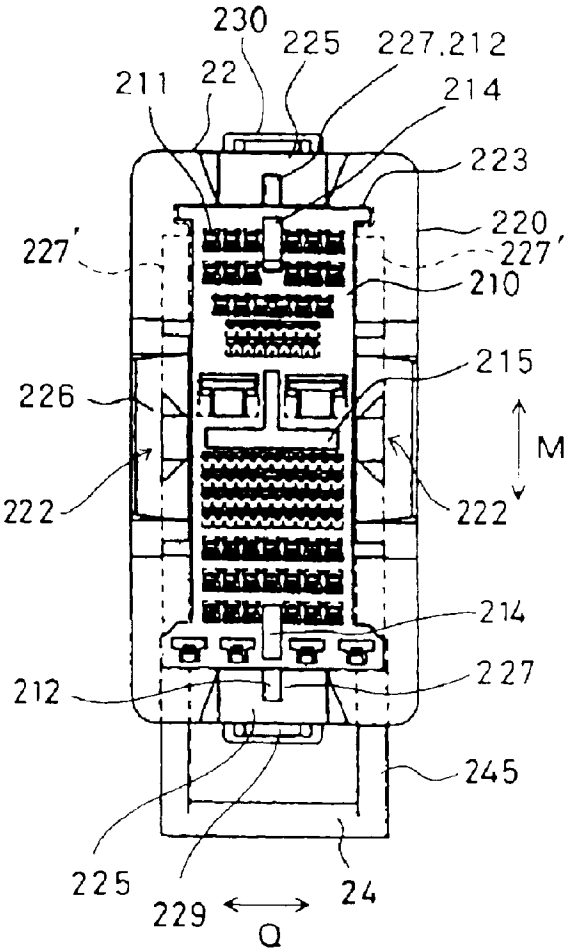
FIG. 3 shows a connector of the instrument module according to the embodiments of the present invention, where FIG. 3(*a*) is a plan view of the connector of the instrument module seen by cross-section, and FIG. 3(*b*) is a front view of the connector and a locator.
Figure 3:
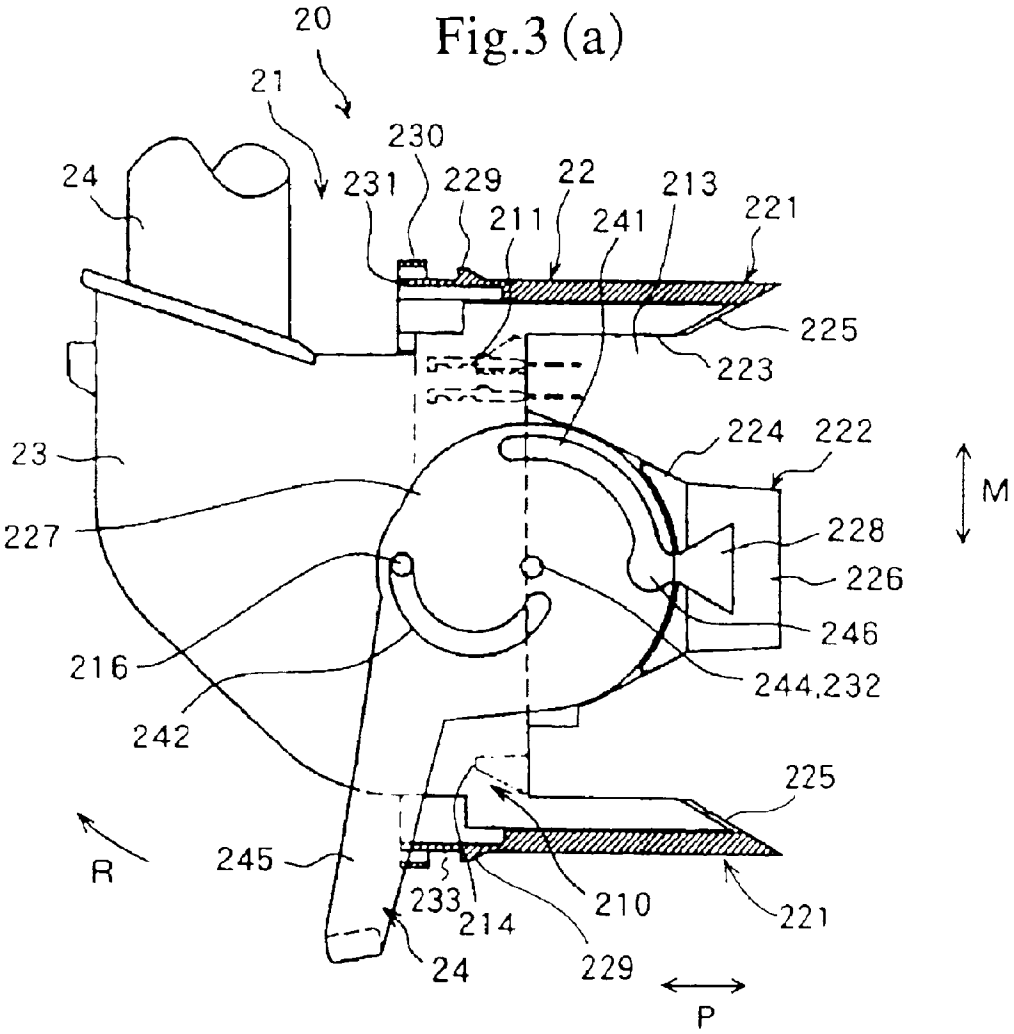

FIG. 3 shows the connector of the instrument module in the embodiments of the present invention, where FIG. 3(*a*) is the plan view of the connector of the instrument module seen by cross-section, and FIG. 3(*b*) is the front view of the connector and the locator.

In FIGS. 2 and 3, reference numeral 21 denotes a connector built in the instrument module. Reference 22 denotes a locator. The locator 22 houses the connector 21 inside thereof in a slidable manner in the axis direction of the terminals, and the connector device 20 essentially consists of the connector 21 and the locator 22. The locator 22 has a housing main body 220 as shown in FIG. 2.

A pair of locating pins (locating protrusions) 221, 221 are provided at terminal portions in P direction of the locator 22, and a pair of locating pins 222, 222 are provided in Q direction. A concave area 213 for receiving a connector 10 of the automobile body, which is a counterpart, is formed inside the locator 22.

Further, slopes 225, 226 for absorbing the deviation or off-set during fitting to the connector of the automobile body are severally formed at the tip of a pair of the locating pins 221, 221.

Parallel surface portions 223, 224 reaching the slopes 225, 226 are formed on the pair of locating pins 221, 221. A groove 227 extending in the axis direction is formed inside the parallel surface portion 223.

The dimensions of the parallel surface portions 223, 224 in the axis direction secures enough dimensions, which is required to prevent the axis core shift of the both connectors, even after fitting the connector 10 of the automobile body to an abutting portion of the locator 22.

Further, a triangular concave portion 228 for receiving a locking pin 102 of the connector 10 of the automobile body is provided for the slope 226 of the locating pin 222.

Reference numeral 210 is a housing main body having a rectangular solid shape, which constitutes the connector 21. A plurality of male terminals 211 are attached to the housing main body 210. Protruded fins 212 that slidably fit the grooves 227 are provided for the both sides of the housing main body 210 in M direction.

Figure 5:
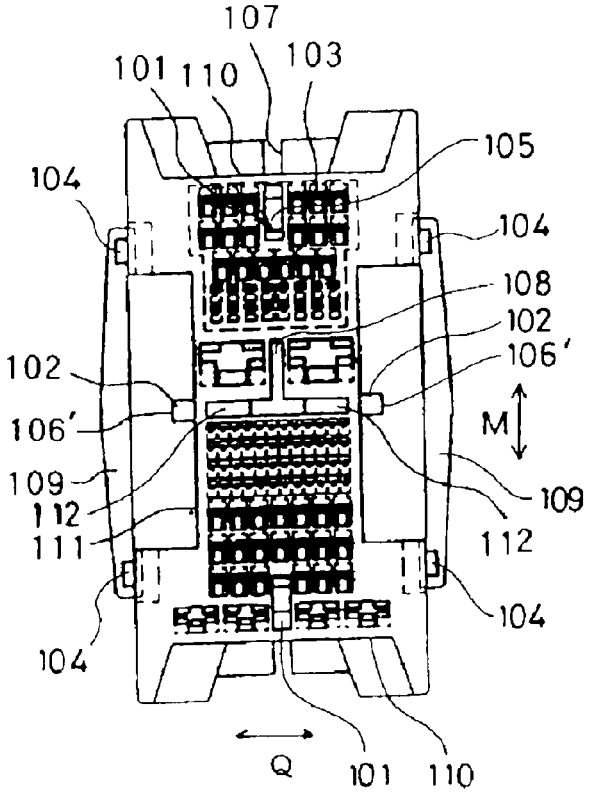
FIG. 5 show a connector of the automobile body according to the embodiments of the present invention, where FIG. 5(*a*) and FIG. 5(*b*) are the front view and the side view of the connector, respectively.
Figure 5:
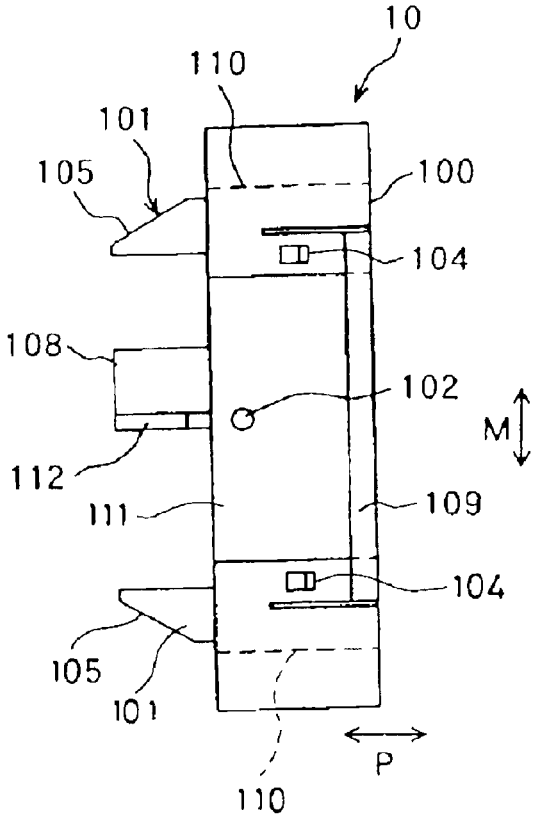

Further, on a surface opposing to the connector 10 of the automobile body, concave portions 214 to which auxiliary locating pins 101 (refer to FIG. 5(*b*)), which are formed on the connector 10 of the automobile body, fit and a concave portion 215 to which a protector 108, which is formed on the connector 10 of the automobile body, fits are provided.

Reference numeral 24 is a lever for facilitating a fitting operation between the connector 21 of the instrument module and the connector 10 of the automobile body.

The lever 24 consists of a handle 245 and a pair of substrate portions 227', 227'. Each substrate portion 227' of the lever 24 is provided with a center hole 244 at a rotation center of the lever.

A center pin 232 provided for the housing main body 220 of the locator 22 is fitted rotatably and slidably as shown in FIG. 3(*a*). The lever 24 is rotatably supported by the housing main body 220 of the locator 22 via the center pin 232 by means of an attaching method (described later).

On each substrate portion 227', a cam groove (notch) 241 of a concentric circular shape having the center hole 244 as a center and a cam groove (slot) 242 extending from the rotation center of the lever toward outside in a radius direction are formed. A guide pin 216, which is integrally formed on the housing main body 210 of the connector 21, is slidably engaged with the cam groove 242.

As the lever 24 elastically deforms the substrate portion 227' inwardly, the elastic deformation of the substrate portion 227' is released after it is inserted in the housing main body 220 of the locator 22, and the center hole 244 and the center pin 232 of the locator 22 are engaged. Thus, the lever 24 is positioned using the locator 22 as a reference.

Next, when the housing main body 210 is inserted between the both substrate portions 227' of the lever 24 from P direction of the substrate portion 227', the guide pin 216 hits a thin material area (not shown) formed near an outer end of the cam groove 242 in the radius direction, and the both substrate portions 227' are opened in directions that they go apart. Next, when the housing main body 210 is pushed into the locator 22, the guide pin 216 fits the cam groove 242, and the locator 22 thus holds the housing main body 210 via the lever 24 such that the body does not pulled out.

In FIGS. 2 and 3, reference numeral 23 denotes a resin harness cover. The harness cover 23 is supported by the housing main body 210 by engaging an engaging protrusion (not shown) provided for the housing main body 210 to an engaging hole (not shown) formed on the harness cover 23.

Figure 4:
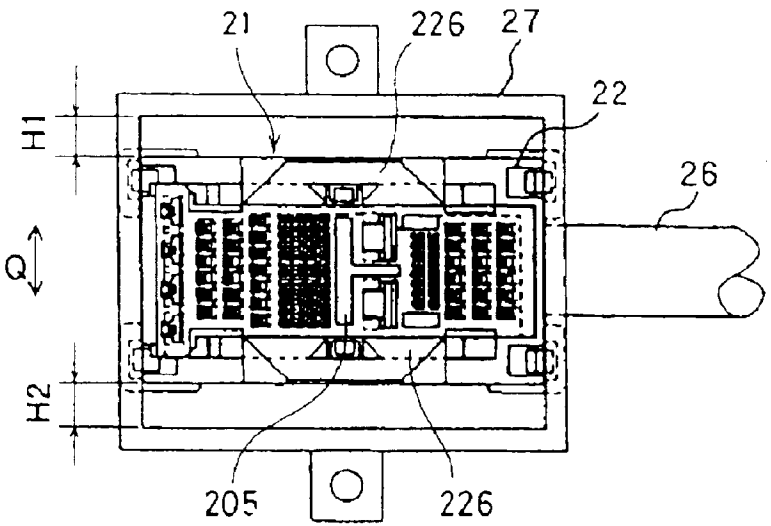
FIG. 4 shows a connector device according to the embodiments of the present invention, where FIG. 4(*a*) shows a front view of the connector device, and FIG. 4(*b*) is a view where the connector device is seen two-dimensionally and a part thereof is shown in cross-section.
Figure 4:
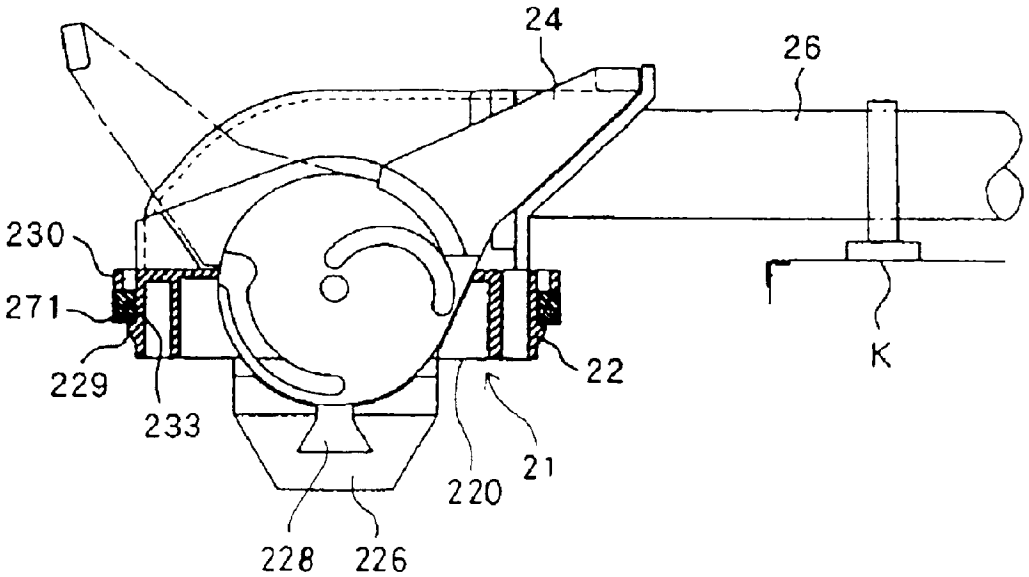

FIG. 4 shows the connector device according to the embodiments of the present invention. FIG. 4(*a*) shows the front view of the connector device, and FIG. 4(*b*) is the view where the connector device is seen two-dimensionally and a part thereof is shown in cross-section.

A hooking nail 229 and a positioning portion 230 are formed on the housing main body 220 of the locator 22. A guide groove 233 is formed between the hooking nail 229 and the positioning portion 230. A rail portion 271 is formed on the bracket 27 of the instrument module as shown in FIG. 2, the rail portion 271 is slidably fitted to the guide groove 233, and thus the connector 21 can be moved with respect to the bracket 27 in Q direction.

The harness 26 is pulled out from the connector 21, and is cabled in a direction orthogonal to a movable direction of the connector 21. Since the harness 26 is fixed to a predetermined region of the instrument module and a dimension to fixing point K for the harness 26 is secured, bending stress and tensile stress by the harness 26 are not applied to the connector 21 even if the connector 21 is moved in the axis direction of terminals and Q direction during the fitting of the connector 21 and the connector 10, the both connectors 10, 21 can be fitted with each other, and it is possible to improve connecting-operation efficiency and reliability of connection of the connectors.

FIG. 5 show the connector 10 of the automobile body according to the embodiments of the present invention, where FIG. 5(*a*) and FIG. 5(*b*) are the front view and the side view of the connector 10, respectively.

The connector 10 has a housing main body 100 of a rectangular solid shape, and a plurality of female terminals 103 are installed inside the housing main body 100.

Auxiliary locating pins 101 are provided for the housing main body 110. The auxiliary locating pin 101 serves to adjust the axis core shift in M direction when fitting with the connector 21. The outer surface of the auxiliary locating pin 101 should be a slope 105.

Parallel surface portions 111, which contact the connector 21 in a sliding manner when the connector 21 fits, are formed on the both ends of the housing main body 100 in Q direction. Locking pins 102 are formed in a protruded manner at the center of the parallel surface portions 111 in M direction.

Parallel surface portions 110, which contact the connector 21 in a sliding manner when the connector 21 fits, are formed on the both ends of the housing main body 100 in M direction. Further, grooves 107, in which the protruded fins 212 of the connector 21 are fitted, are formed at the center in Q direction of the both ends of the housing main body 100.

The protector 108 has a T-letter shape when seen from the front. The protector 108 serves to prevent the female terminals 103 from suffering damage during a fitting operation of the connector 21 and the connector 10, to prevent the female terminals 103 from suffering damage during carriage of the connector 10, and also serves as an auxiliary locating pin for adjusting the deviation in Q direction when fitting the connector 10 with the connector 21. A slope 112 extending in Q direction is formed on the top portion of a linear portion of the protector 108, which extends in Q direction.

Hooking nails 104 and guide portions 109 are formed on the both ends in Q direction of the housing main body 100. An area between the hooking nails 104 and the guide portions 109 is a guide groove for guiding rail portions 281 formed on the bracket 28 shown in FIG. 2. The bracket 28 is attached to the automobile body and serves to support the connector 10. The connector 10 can be moved in M direction due to engagement between the guide groove and the rail portions 281.

A harness 29 is pulled out from the connector 10 as shown in FIG. 2, and cabled in a direction orthogonal to the movable direction (M direction) of the connector 10. Regarding the distance from the harness 29 to a fixing point (not shown) of the automobile body, a predetermined dimension is secured similar to cabling of the harness 26 with respect to the connector 21, so that bending stress and tensile stress by the harness 29 are not applied to the connector 10 even if it moves in M direction with the fitting operation of the connector 21 and the connector 10 and they can be directly fitted with each other. Thus, it is possible to improve connecting-operation efficiency and reliability of connection of the both connectors.

Figures 6A, 6B, 6C:
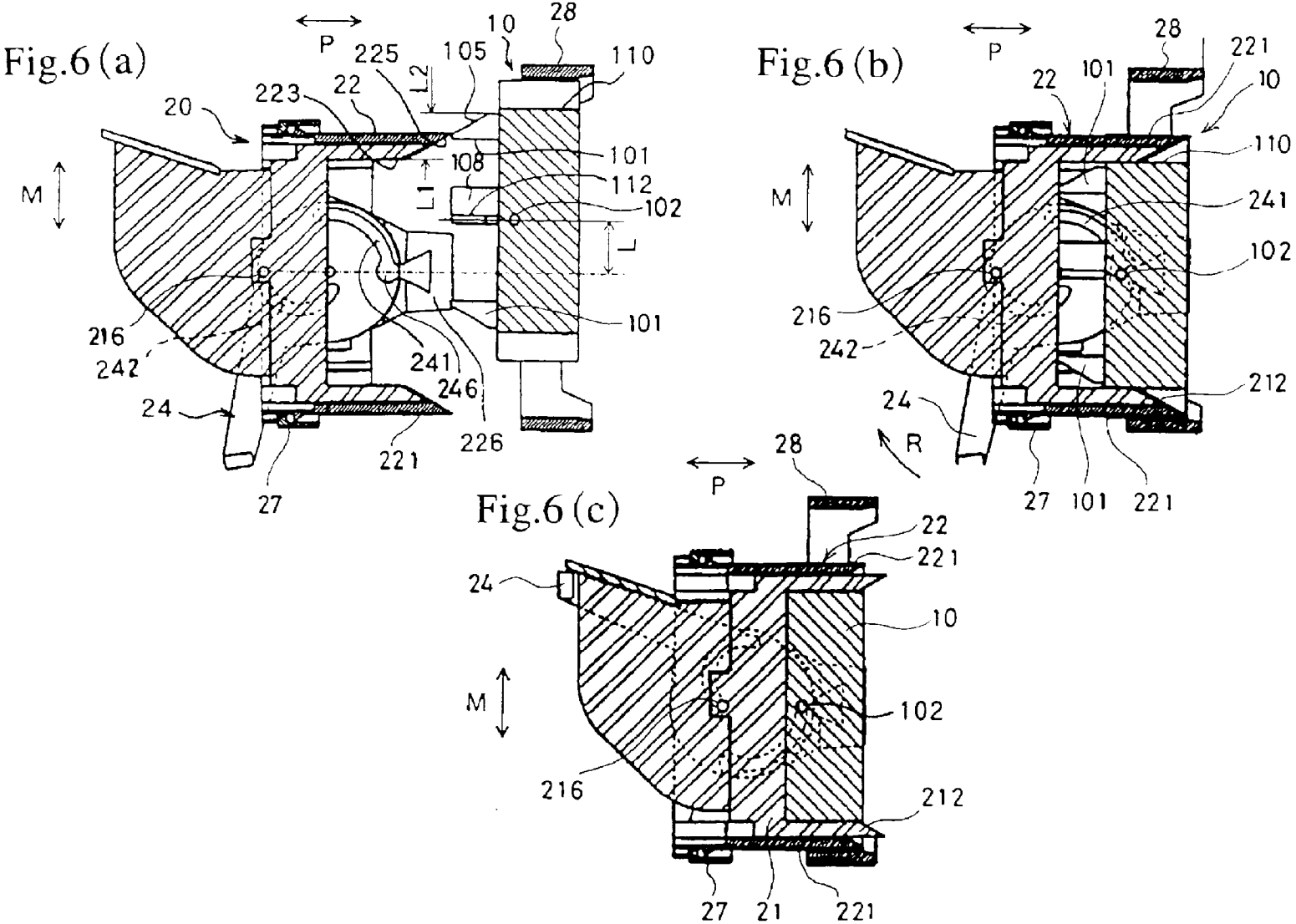
FIG. 6 is an exemplary view of a fitting operation of the connectors according to the embodiments of the present invention, where FIGS. 6(*a*), 6(*b*) and 6(*c*) are a view showing a state immediately before fitting of the both connectors, a view showing a state immediately before rotation of the lever shown in FIG. 5(*a*), and a view showing a state where fitting of the both connectors has completed, respectively.
Figure 7:
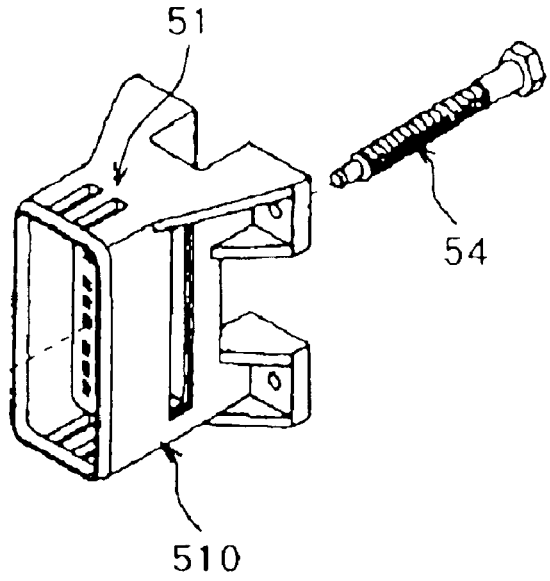
FIG. 7 is a perspective view of a conventional male connector.
Figure 8:
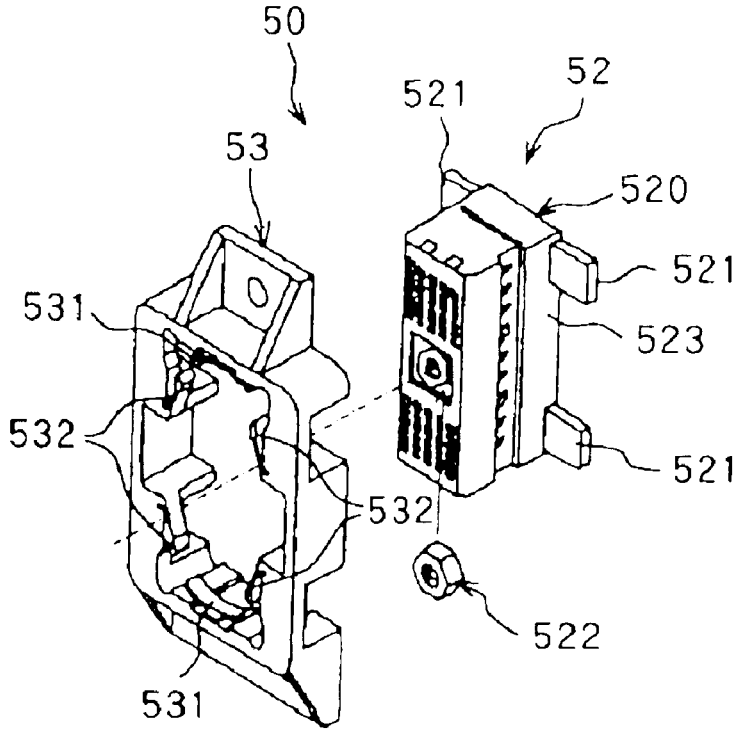
FIG. 8 is an exploded perspective view of a conventional female connector device.
Figure 9:
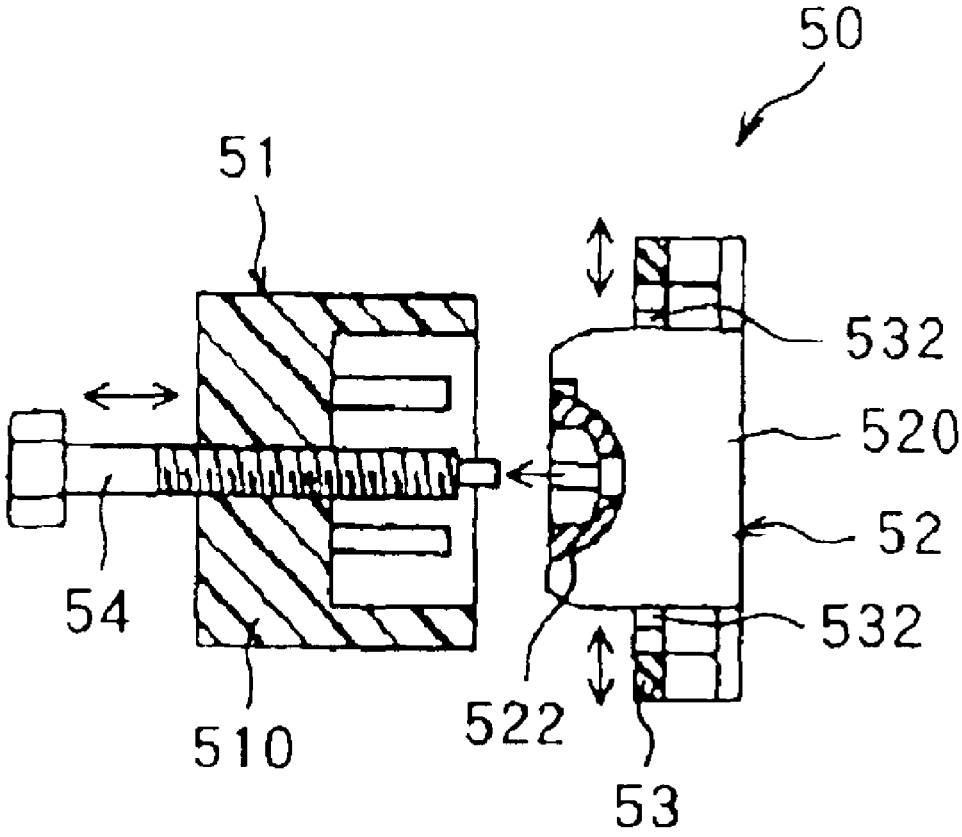
FIG. 9 is an exemplary view showing a state immediately before fitting the conventional male connector and the female connector.

FIG. 6 is the exemplary view of the fitting operation of the connectors according to the embodiments of the present invention.

A description will be made for the fitting operation between the connector of the instrument module and the connector of the automobile body, referring to FIGS. 6(*a*), 6(*b*) and 6(*c*) as follows.

FIG. 6(*a*) shows the state immediately before fitting of the both connectors 10, 21, which shows a state where the connector 10 of the automobile body and the connector 21 of the instrument module are correctly oppose with each other when the instrument module is attached to the automobile body.

This shows the state where the slope 105 of the auxiliary locating pin 101 of the connector 10 have just abutted to the slope 225 of the locating pin 221 of the locator 22. The fitting of the both connectors is impossible if the positions of the locating pin 101 and the locating pin 221 are shifted outside in M direction from the position shown in FIG. 6(*a*). Specifically, the abutting position between the locating pin 101 and the locating pin 221 shown in FIG. 6(*a*) shows a limit position where the fitting of the both connectors 10, 21 becomes impossible.

When the connector 21 of the instrument module is pushed from the state shown in FIG. 6(*a*) to the axis direction (P direction) of the terminals in attaching the instrument module to the automobile body, the connector 10 can be moved in M direction with respect to the bracket 28 due to engagement and contact in a sliding manner between the slope 225 of the locator 22 and the slope 105 of the auxiliary locating pin 101. Accordingly, cores of the connector 10 and the connector 21 are adjusted in M direction.

Further, with the movement of the connector 10 in M direction with respect to the connector 21 and the movement of the connector 21 for the connector 10, the slope 226 of the locator 22 and the slope 112 of the protector 108 are engaged, the end surface 106' of the locking pin 102 (refer to FIG. 5(*a*)) engages and contacts the slope 226 of the locator 22 in a sliding manner, and the connector 21 can be moved in Q direction with respect to the bracket 27 of the instrument module. Thus, the cores of the connector 10 and the connector 21 are adjusted in M direction.

Furthermore, by pushing the connector 21 of the instrument module into the connector 10, the state shown in FIG. 6(*b*) is created.

This shows the state where the instrument module has been attached to the automobile body and the instrument module has been fix to the automobile body with appropriate means such as bolts.

In this state, the parallel surface portions 110 of the connector 10 of the automobile body are in the state where they are fitted with the parallel surface portions 223 of the locator 22 with a predetermined dimension in the axis direction, and the parallel surface portions 111 (refer to FIGS. 5(*a*) and 5(*b*)) of the connector 10 of the automobile body is in the state where they are fitted with the parallel surface portions 224 of the locator 22 with a predetermined dimension in the axis direction. Furthermore, in this state, the locking pin 102 is at the position where it is fitted in an initial end 246 of the cam groove 241 of the lever 24 via the triangular concave portion 228 of the locator 22.

With the state shown in FIG. 6(*b*) where the instrument module has fixed to the automobile body, the position of the connector 10 of the automobile body with respect to the locator 22 in the axis direction (P direction) is controlled with the engagement between the locking pin 102 and the cam groove 241.

When the lever 24 is rotated in arrow R direction in the state shown in FIG. 6(*b*), the position of the connector 10 of the automobile body with respect to the locator 22 in the axis direction (P direction) is controlled with the engagement between the locking pin 102 and the cam groove 241, and the connector 21 is drawn toward the connector 10 by the engagement between the cam groove 232 and the pin 216.

FIG. 6(*c*) shows the state where the fitting of the both connectors 10, 21 has completed, which shows the state where the tip of the protruded fins 212 of the connector 21 fit in the grooves 107 of the connector 10 and the connector 21 and the connector 10 has completely fitted with each other, in which the auxiliary locating pins 101 of the connector 10 are fitted in the concave portions 214 of the connector 21 and the protector 108 is fitted in the concave portion 215 of the connector 21.

In the embodiment of the present invention, the locating pins 221, 222 of the locator 22 are provided with the slopes 225, 226 and the locating pin 101 and the protector 108, which are provided for the connector 10 of the automobile body, are provided with the slopes 105, 112. Thus, an axial adjustment function in M direction works within the range of the added value (L=L1+L2) of dimension L1 of the locator 22 in M direction and dimension L2 of the auxiliary locating pin 101 in M direction of the connector 10 of the automobile body. In the embodiments of the present invention, dimension L is approximately 10 mm, which is an allowable value approximately twice that of the case where the slope 105 is not provided for the auxiliary locating pin 101. The same applies to the axial adjustment function in Q direction.

Therefore, in a conventional connector, it has been inevitable that the connector device becomes large in order to modularize the member of an instrument panel, but it is possible to obtain the connector device that is small and can improve the axial adjustment function according to the present invention.

Further, since the auxiliary locating pin 101 and the protector 108 are provided inside the housing main body 100 and they are completely housed inside the housing main body 210 of the connector 21 when the both connectors 10, 21 are completely fitted, the device is a small size.

Furthermore, since the housing main body 100 of the connector 10 fits in the concave area 213 of the housing main body 210 of the connector 21 and they are fitted with each other by the parallel surface portions having predetermined dimensions in the axial direction, the male and female terminals are prevented from being applied with an axial deviation due to bending stress and tensile stress by the harnesses 26, 29.

Specifically, since the present invention is the self-locating connector characterized in that both the first connector 21 and the second connector 10 can move, where one can move in approximately right and left directions (M direction) and the other can move in approximately up and down directions (Q direction), it is small and has high axial adjustment function, and additionally, there exist an effect that restriction in a direction where the harness is pulled out can be reduced.

Further, according to the present invention, the locator 22 absorbs the axial deviation, movable mechanism of the first connector 21 essentially consists of the guide groove 233, which is formed by the positioning portion 230 and the hooking nails 229 on the housing main body of the locator of the first connector, and the rail portion 271 of the bracket 27 to which the first connector 21 is attached, and the movable mechanism of the second connector 10 essentially consists of the guide groove, which is formed by the hooking nails 104 and the guide portions 109 on the housing main body 100 of the second connector 10, and the rail portion 281 of the bracket 28 to which the second connector 10 is attached. Therefore, the absorption quantity of axial deviation can be made large even if the connector is small.

Moreover, each of the first connector 21 and the second connector 10 is provided with the parallel surface portions to absorb the axial deviation, it is possible to prevent the male terminals and the female terminals from suffering bending stress and tensile stress by the harness during the fitting of the both connectors.

Further, since the rotating operation of the lever 24 ensures the fitting, connecting-operation efficiency between the both connectors and the reliability of connecting operation can be improved.

In addition, since the harness 26 cabled to the first connector 21 is cabled in a direction orthogonal to the movable direction of the first connector 21 and the harness 29 cabled to the second connector 10 is cabled in the direction orthogonal to the movable direction of the second connector 10, the connectors do not suffer from bending stress and tensile stress by the harnesses 26, 29, and thus the connecting-operation efficiency and the reliability of connection can be improved.

What is claimed is:

1. A self-locating connector, comprising:

a first connector that houses male terminals or female terminals;

a second connector that houses the female terminals or the male terminals;

a support bracket that slidably supports said first connector;

a support bracket that slidably supports said second connector; and a locating mechanism for automatically adjusting an axial deviation between said first and second connectors for moving said first and second connectors when fitting said first and second connectors, while moving one of said first and second connectors in substantially right and left directions, and moving the other one of said first and second connectors in substantially up and down directions.

2. The self-locating connector according to claim 1, further comprising:

a locator that inserts a housing main body of said first connector inside said locator slidably in an axial direction of said male terminals or said female terminals, wherein the locator adjusts the axial deviation between first and second connectors.

3. The self-locating connector according to claim 2, wherein at least a pair of locating pins, which have a slope for guiding said second connector to facilitate fitting of said second connector, are provided on the tip of said locator, and said second connector is provided with auxiliary locating pins having slope that inscribes the slope of the pair of locating pins.

4. The self-locating connector according to claim 2, wherein a lever, which has a handle operation portion and is capable of moving said first connector in an axis direction with respect to said locator, is provided for a housing main body of said locator, said lever is provided with a cam groove that engages with a guide pin, which is provided for said first connector in a protruding manner, and cam grooves that engage with a pair of guide pins, which are provided on a pair of parallel surface portions of said second connector in a protruding manner, said locator rotatably supports said lever, and said first and second connectors are fitted by rotating said handle operation portion.

5. The self-locating connector according to claim 1, wherein a harness cabled to said first connector is cabled by being pulled out in a direction orthogonal to the movable direction of said first connector, and a harness cabled to said second connector is cabled by being pulled out in a direction orthogonal to the movable direction of said second connector.

6. A self-locating connector, comprising:

a first connector that houses male terminals or female terminals;

a second connector that houses the female terminals or the male terminals;

a support bracket that slidably supports said first connector;

a support bracket that slidably supports said second connector, and a locator that inserts a housing main body of said first connector inside said locator slidably in an axial direction of said male terminals or said female terminals, wherein the locator adjusts the axial deviation between said first and second connectors, wherein one of said first and second connectors is moved in substantially right and left directions when fitting said first and second connectors, the other one of said first and second connectors is moved in substantially up and down directions, and an axial deviation between said first and second connectors is automatically adjusted, and wherein said locator has a housing main body, guide grooves formed by a positioning portion and a hooking nail are provided for the housing main body, rail portions guided by said guide grooves are formed on the support bracket that supports said first connector, the housing main body of said second connector is provided with the guide grooves formed by the hooking nail and a guide portion, rail portions guided by said guide grooves are formed on a the support bracket that supports said second connector, and movable mechanism of said first connector and movable mechanism of said second connector are made up of said guide grooves and said rail portions respectively.

7. A self-locating connector, comprising:

a first connector that houses male terminals or female terminals;

a second connector that houses the female terminals or the male terminals;

a support bracket that slidably supports said first connector;

a support bracket that slidably supports said second connector, and a locator that inserts a housing main body of said first connector inside said locator slidably in an axial direction of said male terminals or said female terminals, wherein the locator adjusts the axial deviation between said first and second connectors, wherein one of said first and second connectors is moved in substantially right and left directions when fitting said first and second connectors, the other one of said first and second connectors is moved in substantially up and down directions, and an axial deviation between said first and second connectors is automatically adjusted, wherein at least a pair of locating pins, which have a slope for guiding said second connector to facilitate fitting of said second connector, are provided on the tip of said locator, and said second connector is provided with auxiliary locating pins having slope that inscribes the slope of the pair of locating pins, wherein said locator is provided with a concave area, which is made up of a pair of parallel surface portions having predetermined dimensions in an axial direction followed by said slope, said second connector is provided with a pair of parallel surface portions followed by said slope, which contacts the pair of parallel surface portions of said first connector in a sliding manner, and an axial deviation is automatically adjusted by the parallel surface portions formed on said first and second connectors before fitting of male terminals and female terminals during a fitting operation of said male and female terminals starts.

8. A self-locating connector, comprising:

a first connector that houses male terminals or female terminals;

a second connector that houses the female terminals or the male terminals;

a support bracket fixed to an instrument module and that slidably supports said first connector;

a support bracket fixed to an automobile body and that slidably supports said second connector in a direction orthogonal to the movable direction of said first connector; and a locating mechanism for automatically adjusting an axial deviation between said first and second connectors by moving said first and second connectors when fitting said first and second connectors, while moving one of said first and second connectors in approximate right and left directions, and moving the other one of said first and second connectors in approximate up and down directions.

* * * * *